US006645084B1

(12) United States Patent
Dayton

(10) Patent No.: US 6,645,084 B1
(45) Date of Patent: Nov. 11, 2003

(54) GOLF CLUB WITH ATTACHED TRAINING WHEEL

(76) Inventor: Stephen Michael Dayton, 2336 Douglas St., Apt. #617, Austin, TX (US) 78741

( * ) Notice: Subject to any disclaimer, the term of this patent is extended or adjusted under 35 U.S.C. 154(b) by 0 days.

(21) Appl. No.: 10/224,781

(22) Filed: Aug. 21, 2002

Related U.S. Application Data

(60) Provisional application No. 60/317,067, filed on Sep. 4, 2001.

(51) Int. Cl.[7] ..... A63B 69/36
(52) U.S. Cl. ..... 473/230; 473/228
(58) Field of Search ..... 473/227, 228, 473/224, 230, 234, 256

(56) References Cited

U.S. PATENT DOCUMENTS

| | | | | | |
|---|---|---|---|---|---|
| 2,255,332 | A | | 9/1941 | Russell | |
| 2,300,043 | A | | 10/1942 | Carney | |
| 2,910,297 | A | * | 10/1959 | Bonetate | 473/228 |
| 3,044,781 | A | | 7/1962 | Murphy | |
| 3,175,328 | A | * | 3/1965 | Tricarico | 446/452 |
| 3,319,964 | A | * | 5/1967 | Steinberg | 473/230 |
| 3,351,346 | A | * | 11/1967 | Strahan | 473/256 |
| 3,758,117 | A | * | 9/1973 | Harrison | 473/231 |
| 3,776,556 | A | * | 12/1973 | McLaughlin | 473/234 |
| 3,809,397 | A | * | 5/1974 | Gruenewald | 473/457 |
| 4,688,799 | A | | 8/1987 | Johnson | |
| 4,756,535 | A | | 7/1988 | Bradley | |
| 4,907,800 | A | | 3/1990 | Passamaneck | |
| 5,100,148 | A | * | 3/1992 | Smith | 473/228 |
| 5,121,925 | A | | 6/1992 | Blundo | |
| 5,174,567 | A | | 12/1992 | Nordstrom | |
| 5,310,188 | A | * | 5/1994 | Hernberg | 473/206 |
| 5,395,107 | A | * | 3/1995 | De Pippo | 473/451 |
| 5,415,406 | A | * | 5/1995 | Reichenbach et al. | 473/228 |
| 5,571,048 | A | * | 11/1996 | Kenney | 473/228 |
| 5,620,377 | A | | 4/1997 | Glockner | |
| 6,238,299 | B1 | * | 5/2001 | Barnette | 473/228 |

* cited by examiner

*Primary Examiner*—Paul T. Sewell
*Assistant Examiner*—Nini F. Legesse

(57) ABSTRACT

A golf swing training device comprises a free-spinning wheel or roller assembly mounted permanently or secured detachably to a golf club of virtually any design, which accelerates learning by conceptually substituting a simple, cohesive, and intuitive action for the complex and seemingly disjointed motions of the golf swing. The position and alignment of the wheel assembly provides inherent and easily discernible visual references with respect to the desired aim and lie angle of the golf club. The user, after adopting an orthodox setup, will be encouraged to roll the wheel back with both arms, and then vigorously and forcibly bring the club and wheel assembly forward toward the intended target to induce momentary, tangential contact with the surface of the ground, causing the wheel to rotate freely—a direct indication of the quality, timing, and speed of the release of the hands.

4 Claims, 12 Drawing Sheets

GOLF CLUB WITH ATTACHED TRAINING WHEEL

CROSS-REFERENCE TO RELATED APPLICATION

This application is entitled to the benefit of Provisional Patent Application Serial No. 60/317,067 filed Sep. 4, 2001.

FEDERALLY SPONSORED RESEARCH

Not Applicable

1. Background—Field of Invention

This invention relates to golf swing training devices, specifically to modified or augmented golf clubs intended to facilitate and accelerate the learning of the golf swing.

2. Background—Description of Prior Art

The invention described herein is a training device intended to facilitate and accelerate the learning of the golf swing, by replacing the complex and difficult-to-master sequence of human-body movements with a simpler, more intuitive action. Metaphorically speaking, this invention will assist the user in learning a functional and effective golf swing motion in virtually the same way that training-wheels attached to a bicycle assist a person in learning how to ride. Golf is arguably the greatest game ever conceived, yet the time and effort required to learn how to play well prevents many people—perhaps most—from enjoying the full dimension of the sport. Numerous gadgets and so-called "secrets" exist in the marketplace which claim to shorten the learning curve and promise to "take strokes off your game," but the most experienced golfers know that nothing substitutes for tenacity and pure practice, preferably with the aid of lessons from a qualified teaching professional. The cost of such an endeavor—to become proficient at golf—can usually be measured in the thousands of dollars, and the requisite time can almost certainly be measured in years. My device is not a substitute for practice or lessons, but rather a novel and useful enhancement for the same, which is attached (and can be made detachable in a related embodiment) to any standard golf club conforming to USGA or British R&A specifications, or practically any conventional golf club.

As will be explained, it is this inventor's contention (and many other students of the game) that the main problem in learning the golf swing lies NOT in the difficulty of performing the physical motion necessary to properly strike a golf ball, but in the understanding of the motion itself—the ability to fathom the spatial and dynamic relationships between oneself, the club, and the very ground the ball rests upon. Ben Hogan, a golfer of legendary ability, in his book *Five Lessons: The Modern Fundamentals of Golf,* wrote:

> "Try to visualize your proper plane and to keep your arms traveling on that plane as you swing the club back. Quite a few of my friends have told me that once they got the idea of the plane into their heads, it worked wonders for them . . . I can believe it. I really never felt that my own backswing was satisfactorily grooved or could be satisfactorily grooved, until I began to base my backswing on this concept of the plane."

Clearly, this passage is strong evidence suggesting that the primary challenge of learning the golf swing is largely mental or conceptual in nature. In fact, many of golf's most successful instructors make extensive use of metaphors and analogies when imparting to students the intricacies of the golf swing. "Swing a bucket of water", "Turn in a barrel", or "Shake hands on the backswing" are a few popular images which can be routinely found in golf publications. Tom Watson, a golfing legend in his own right, in his book *Getting Back to Basics,* echoes Hogan's sentiments:

> "When I have played my best, all I thought about was keeping the club on the right path. Visualizing that path becomes simpler if you think of the swing as a tilted circle around your body."David Leadbetter, currently one of the top golf teachers in the world, and a huge advocate of swing images and drills, provides direct confirmation in his book *Faults and Fixes:*
>
> "Fault No. 11: Poor mental picture of the swing . . . their problem is that they work on their swing piecemeal, without ever really having a clear mental picture of what the finished product should actually look like . . . focusing on 'bits' can make it difficult to link the many component parts into one continuous flowing motion. So the simpler the image the better."

If a device could be invented which conceptually integrated and simplified the "piecemeal" complexities of the golf swing, in addition to providing intrinsic visual, auditory, and kinesthetic feedback regarding clubface position, body alignment, direction of the swing path, as well as clubhead speed, clearly it would be of value to many prospective golfers. Justification for the golf club-wheel assembly described in this document is founded upon this very proposition; namely, that asking someone, yea anyone, to vigorously roll a wheel on the end of a stick, tangentially across the ground in the direction of the intended target, is inherently easier to imagine and perform than asking him or her to execute a correct golf swing motion. Furthermore, it is my belief that the two motions are essentially equivalent, and most importantly, similar to training wheels on a bicycle, the device described in the specification and drawings to follow provides a natural and intuitive transition to a functional, consistent golf swing, because it is detachably mounted to the actual golf club itself.

The prior art under the subject of wheels or rollers as they apply to golf clubs (Class 473—Games Using Tangible Projectile, Subclass 230—Wheel) contains several ingenious and interesting patents. Insofar as I am aware, none of these devices were designed for the purpose stated above, and therefore the practical form of these instances of attached wheels or rollers is substantially different than my invention shown in the subsequent accompanying drawings. U.S. Pat. No. 4,688,799 to Johnson (1987) and U.S. Pat. No. 2,255,332 to Russell (1941) show rollers attached to wood-type clubs used for striking tee shots, with the expressed purposes, respectively, of " . . . vertically positioning and stabilizing or controlling the height of a golf club above the ground at the moment of impact with the golf ball" and " . . . enabling the player to make a more powerful and natural stroke without marring the turf." No application of these devices to iron-type clubs is claimed or illustrated (and the utility would be questionable given that an iron club, by definition, makes tangible contact with the ground, often resulting in a divot of turf being taken), and the small size and unobtrusive position of the rollers would make each of them ineffective as a conceptual tool having the utility described in this document. The invention described here has large and easily discernible visual alignment references, as well as auditory and kinesthetic feedback based on wheel rotational speed. Johnson's and Russell's inventions are spacer or shim-type remedies specifically designed for alleviating errors in the height of the clubhead as it impacts the ball—to prevent the "fat shot" where the clubhead digs excessively into the ground. Johnson's and Russell's roller attachments are both examples of an "improved golf club,"

and both were not intended to address the issue of learning or training the golf swing, conceptually or otherwise.

In U.S. Pat. No. 2,300,043 (1942), Carney embeds a small roller having rachet-type noisemaking capability into the soleplate of a wood-type club, to "keep the golfer conscious that he is dragging his club along the ground during the back stroke of his drive." Carney's device is a novel, auditory feedback type tool, but he limits it to "woods" and to only the backswing action itself. The fact that the roller is tiny and hidden beneath the clubhead negates any utility for visible alignment purposes and, in my opinion, would make it ineffective as a visual metaphor for the full golf swing; indeed, Carney makes no such claims.

Although the invention involves no wheel or roller attachment, U.S. Pat. No. 5,620,377 to Glockner (1997) describes a detachable "guide surface" which " . . . acts like the runner of a sled and causes the head of the club to slide on the ground without damaging the ground." Glockner's stated aim is to prevent damage to the turf and injuries to the golfer, and makes no mention of the possible conceptual use of his device for training and learning the golf swing. The metaphor of a "sled" mounted to a stick has considerable value as a golf swing image, although I believe a wheel employed for the same purpose has definite advantages to be discussed later.

U.S. Pat. No. 3,044,781 to Murphy (1962) describes a practice golf club with a spring-loaded roller integral with the clubhead, for the purpose of allowing " . . . a golfer to practice his swing on any surface without fear of injuring the club or the practice surface . . . " Murphy is primarily concerned with enabling a golfer to practice indoors or on hard surfaces, by allowing relative motion between the clubhead and the clubshaft. His clever roller is an anti-friction, shock-absorbing device, and is not specifically designed for the conceptual learning process described earlier. The roller is small and neatly packaged beneath the flange of the clubhead, and thus would not be optimal for a swing metaphor or visible alignment reference; furthermore, having a low rotational moment-of-inertia and no discernible bearings other than a tiny spindle, the roller was not intended to be spun freely to provide auditory or kinesthetic feedback for clubhead speed.

U.S. Pat. No. 5,174,567 to Nordstrom (1992) shows a hockey-stick type device with an attached wheel to "provide aerobics training and weight training to an athlete." Nordstrom's drawings depict a conventional, wooden hockey stick, and the design excludes any mention of a golf club or clubhead attachment. Nordstrom's emphasis is on "all-season" physical conditioning of the ice-hockey player, rather than addressing the subtleties of golf swing technique or the mental conditioning of the golfer. Two other physical training type devices involving rotating attachments are contained in U.S. Pat. No. 5,121,925 to Blundo (1992) and U.S. Pat. No. 4,907,800 to Passamaneck (1990) which only provide weighted and/or aerodynamic resistance for building muscles appropriate for the golf swing.

U.S. Pat. No. 4756,535 to Bradley (1988) describes a golf putter with a roller attachment for the purpose of training the putting stroke, although no claim is made on woods or irons or any other type of golf equipment suitable to learning the full golf swing.

Numerous patents under Class 473 have been granted for golf devices which provide visual, auditory, or kinesthetic feedback to assist the golfer in forming a conceptual image of the golf swing, or to compare his or her swing to established references. Many of these devices are permanently fixed or mechanically clamped to the shaft of a club, and employ sound, or light, or motion, or leave visible traces on the ground, or provide data displayed on a computer screen. There are far too many to list here, but insofar as I am aware, none of these devices employs a wheel assembly of the form and purpose described and illustrated in the subsequent pages of this document.

SUMMARY

The invention is a free-spinning wheel or roller assembly mounted directly to a standard golf club. The wheel assembly can be affixed to the shaft of the golf club in a permanent or semi-permanent fashion (similar to the manner in which a shaft is mounted into the hosel of the clubhead) using epoxy products or other adhesives, brazing, soldering or welding, or can be made integral with the hosel portion of the clubhead itself, or can be mechanically clamped or fixed to the hosel and/or shaft so that it may be installed detachably on virtually any golf club. The exact size of the wheel itself is largely dictated by the design of the golf club, in particular the lie angle and hosel length, and for a standard seven-iron, if the wheel is designed to contact the ground to the same degree as the bottom flange or "bounce" of the clubhead, the outer diameter calculates to approximately six and one-half inches, and the thickness is approximately one-half inch. The size of the wheel and its precision mount provide highly visible alignment references to the eye of the golfer as he or she addresses the ball, clearly revealing the target line, the orientation of the clubface, and the lie of the club with respect to the ground. These references provide valuable feedback for correcting errors in a golfer's posture and address position, as well as assisting more advanced golfers in learning how to shape shots with controlled sidespin, i.e. draws and fades. In the preferred embodiment, the wheel itself is fabricated with a compliant material, to absorb the shock of impact with the ground for novice golfers, although virtually any wheel constructed to the correct diameter so that it will make contact with the ground to a similar degree as the clubhead itself will suffice. The perimeter of the wheel is designed to minimize slippage and maximize tangential, frictional and/or penetrative engagement with the ground via protrusions, tack, or surface roughness, and a radial bearing is employed at the hub of the wheel to minimize rotational friction and maximize angular velocity. The wheel can be supplemented with a noisemaking and/or light-emitting device to provide audible or visible feedback and function as a swing speed indicator. The construction of the attached wheel assembly is designed to add minimal mass to the golf club by using lightweight, stiff materials such as magnesium, aluminum, reinforced nylon, advanced graphite-epoxy composites, fiberglass or other engineering plastics, although additional weight may be advantageous to users seeking a physical training device which promotes muscular development.

Objects and Advantages

In addition to the objects and advantages stated previously, the primary object and advantage of this invention—a golf club with an attached training-wheel assembly—is to simplify the user's concept or mental image of the golf swing and replace a potentially complex sequence of actions with an intuitive motion that is easy to understand and perform. The user will be instructed to adopt a completely orthodox posture, stance, grip, and ball position, because the presence of the wheel assembly and its easily discernible alignment references will complement and encourage these important fundamentals. From there, the user will be instructed to take or "roll" the club/wheel back away from the intended target with both arms, and then bring it forward forcibly in a manner such that the wheel engages the ground tangentially at high-speed, causing the wheel to rotate, whereupon it then leaves the ground once again, spinning freely, and continues upward and forward in the direction of the target. It can be explained to the user that a perfect analogy for the action desired is the landing gear on an airplane performing a "touch and go" landing on a runway. The airplane descends until the landing wheels make momentary contact with the runway, causing them to rotate, and then the airplane ascends back upward into the sky. In all other respects, this invention will perform as a standard golf club, including allowing the actual striking of golf balls, because the presence of the wheel assembly will not hinder, and most likely will tend to improve the normal action of the clubhead, since the rolling wheel will promote a shallow, sweeping trajectory instead of a steep, digging attack on the ball. Rolling or spinning the wheel forward, inducing tangential contact with the ground; will emphasize swinging the club completely through the ball toward the target, and will reduce the emphasis on hitting AT the ball, a common error shared by countless golfers. With practice and observation, the relationship of the wheel orientation with respect to the position of the shaft as it approaches and then departs along the target line on the ground, and the resulting rotation of the clubface through impact will become a valuable mental image and will foster a deep understanding of the geometry of the golf swing.

Metaphorical, intuitive commands such as "Roll the wheel toward the target" or "Spin the wheel against the ground as fast as you can" or "Roll it back, then roll it forward" or "Hurl the discus on a stick" or "Bowl the roller down the target line" will be used which emphasize the entire swing motion instead of the typical, confusing "piece-meal" golf instructions such as "Keep your left wrist flat." The timing and synchronization of the release (or crossover of the hands) is perhaps the most critical aspect of the downswing, and most average and novice players suffer from a release that is too early or too late with respect to the rotation of their body, causing errant shots. By instructing users to maximize the spinning action of the wheel against the ground, their attention will be focused on accelerating the club through impact and in the direction of the intended target, thus improving the timing and speed of the release. If the noisemaking or light-emitting feature is employed, the student can be encouraged to "Make as much noise as possible" or "See how high (or repeatable) of a sound pitch you can make" or "Light it up." As stated earlier, it is the inventor's belief that if the golf club with attached training-wheel assembly is used religiously in such a fashion, the resulting motion will be essentially identical to a functional and effective golf swing motion. Ideally, the user will allocate time to practice with, and without, the wheel device (by either removing the wheel or having a second club sans wheel assembly), in order to develop feel for the clubhead and be able to distinguish the somewhat different sensations associated with a real golf club. In an advanced embodiment, the wheel assembly will have minimal weight and thus the kinesthetic sensations produced by swinging the wheel-augmented club will be very similar to an actual golf swing. In time, the motion can be memorized to the point where the training-wheel assembly can be removed completely, and yet the simple mental image will remain. At this point the user will be on his or her own to continue to evolve and enjoy the game of golf to his or her fullest potential.

Related Embodiments

The wheel or roller assembly itself can be designed and attached to the golf club in a variety of ways, and a multitude of cosmetic or artistic "looks" to the wheel itself can be employed without changing the intended use or spirit of the invention. Several alternative embodiments are included among the attached drawings.

While the forms of apparatus herein described constitute preferred embodiments of the invention, it is to be understood that the invention is not limited to these precise forms, and that changes may be made therein without departing from the scope of the invention defined by the appended claims.

DRAWINGS & DESCRIPTION

FIG. 1 contains an isometric view and three orthographic (top, front, right) views of the preferred embodiment of the invention. The golf club depicted is a standard seven-iron.

FIG. 2 is an exploded view of one possible construction of the wheel assembly. An inner hub 11 made of metal, plastic, or other lightweight structural material is mounted on and affixed to a standard golf club shaft 12, resting flush against or in close proximity to the hosel of the clubhead 13. The inner hub is press-fitted and affixed via epoxy or other means into a precision radial bearing 14 made of metal and/or plastic, which is then press-fitted and affixed via epoxy or other means into an outer hub component 15. The outer hub is made of metal, plastic, wood, engineering composites, or other lightweight materials (or can be constructed like a bicycle wheel rim assembly having spokes), and has the appropriate width and features in the perimeter to allow capture of a compliant, ring-shaped tread component 16. The tread ring is optional and/or replaceable. Ideally, in the preferred embodiment shown here, the shaft is inserted through the bore in the inner hub component before being bonded into the hosel of the clubhead in the normal manner. The wheel assembly is then precisely aligned, possibly with the help of special fixturing, to the clubhead itself before it is permanently bonded or mechanically locked into position.

FIG. 3 is a closeup isometric view of the completed wheel assembly and clubhead.

FIG. 4 contains three orthographic views showing the precise alignment of the wheel assembly to the golf club itself. The seven-iron depicted was designed with a lie angle of 62 degrees with respect to the ground plane 18, and is shown squarely aligned to a target in a manner such that a line passing through the leading edge of the clubface 19 is parallel to the ground plane and perpendicular to the target line 20. The attached wheel assembly is oriented with the axis of rotation of the wheel 21 aligned parallel to the leading edge of the clubface 19, perpendicular to the target line 20, and hence parallel to the ground plane 18. This places the wheel in an orientation such that a plane passing through the perimeter of the wheel and perpendicular to the axis of rotation, is aligned exactly perpendicular to the ground plane and parallel to the target line. When the club is positioned correctly at address, the alignment of the wheel assembly thus establishes highly visible references to the ground and the target line. These references will also allow an advanced golfer to create controlled sidespin and can teach a novice golfer how perturbations in the alignment of his or her body and the club can be used to shape shots right or left, i.e. fades or draws.

Figures 1A, 1B, 1C, 1D:
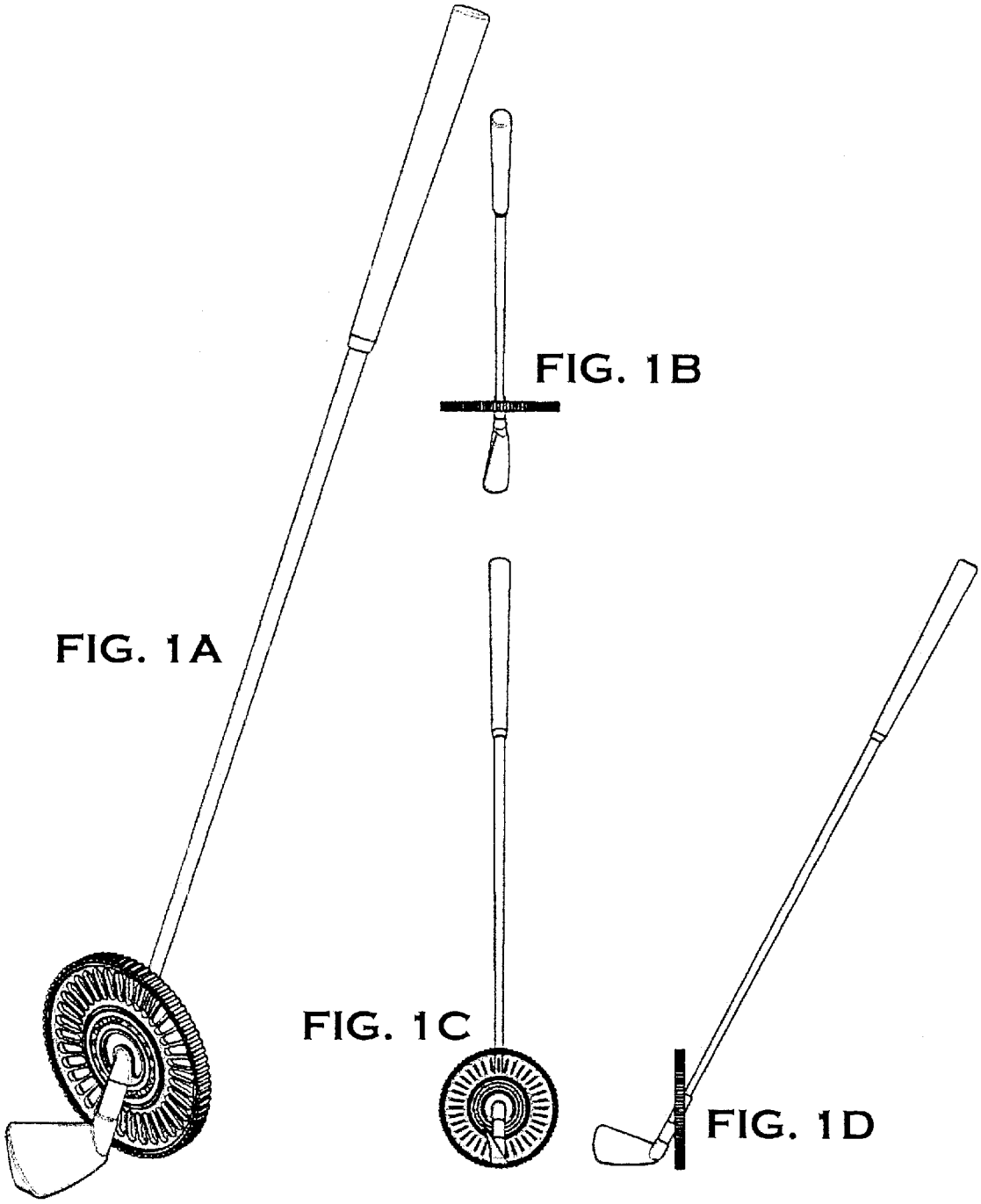
Figure 2:
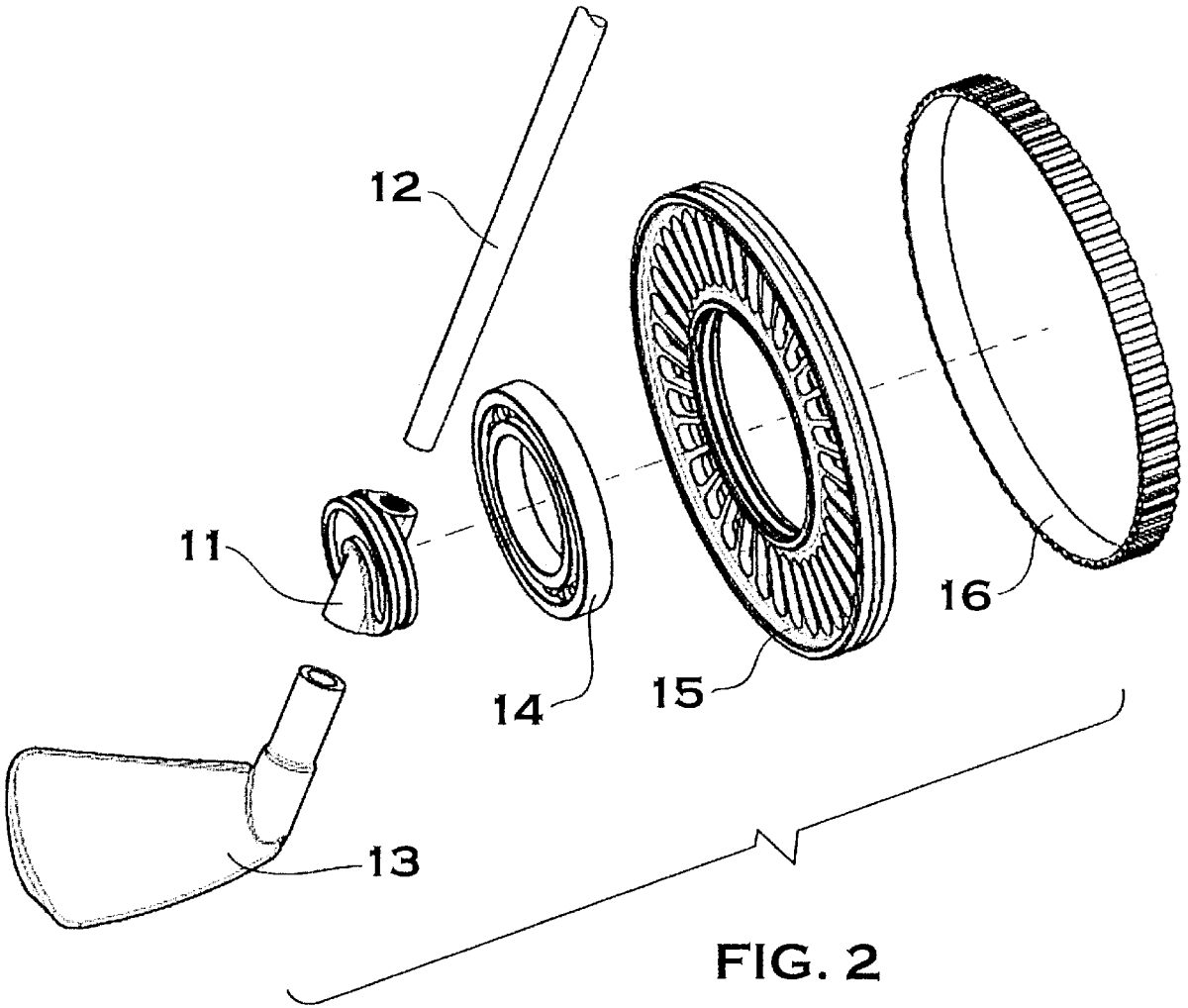
Figure 3:
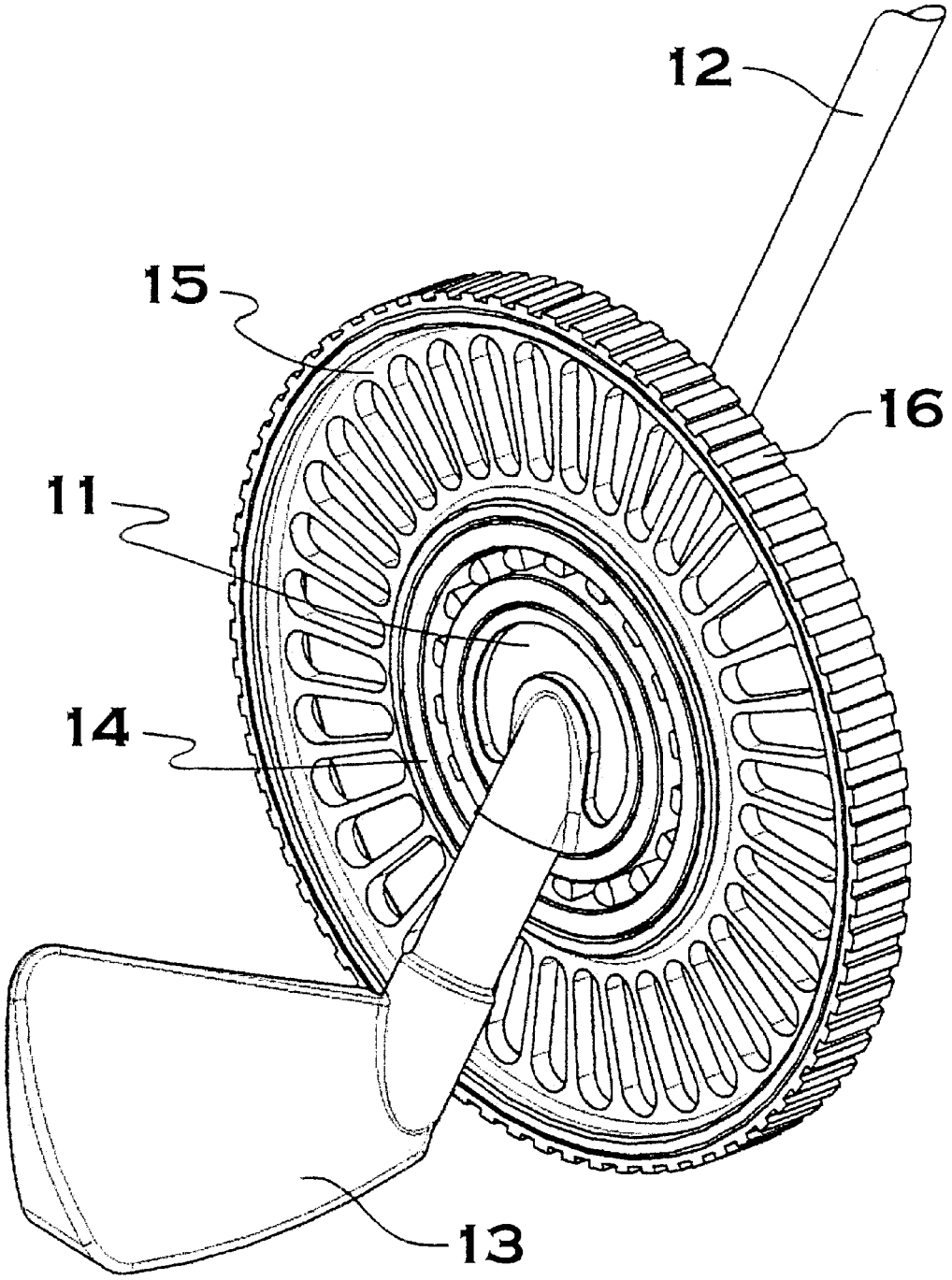
Figure 4A:
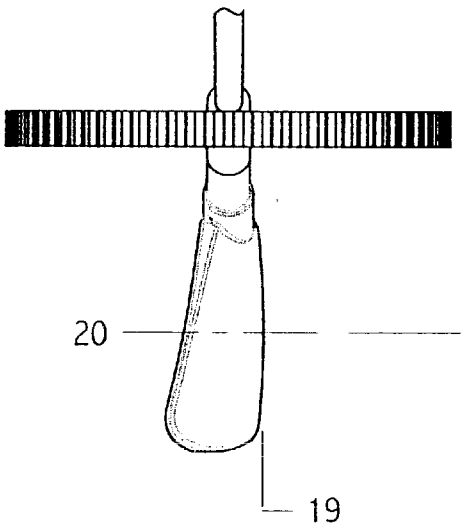
Figure 4B:
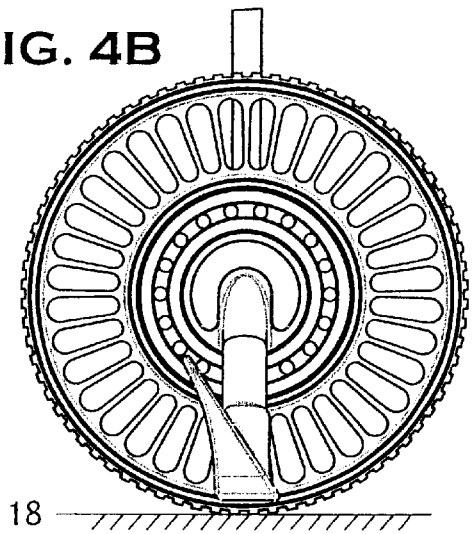
Figure 4C:
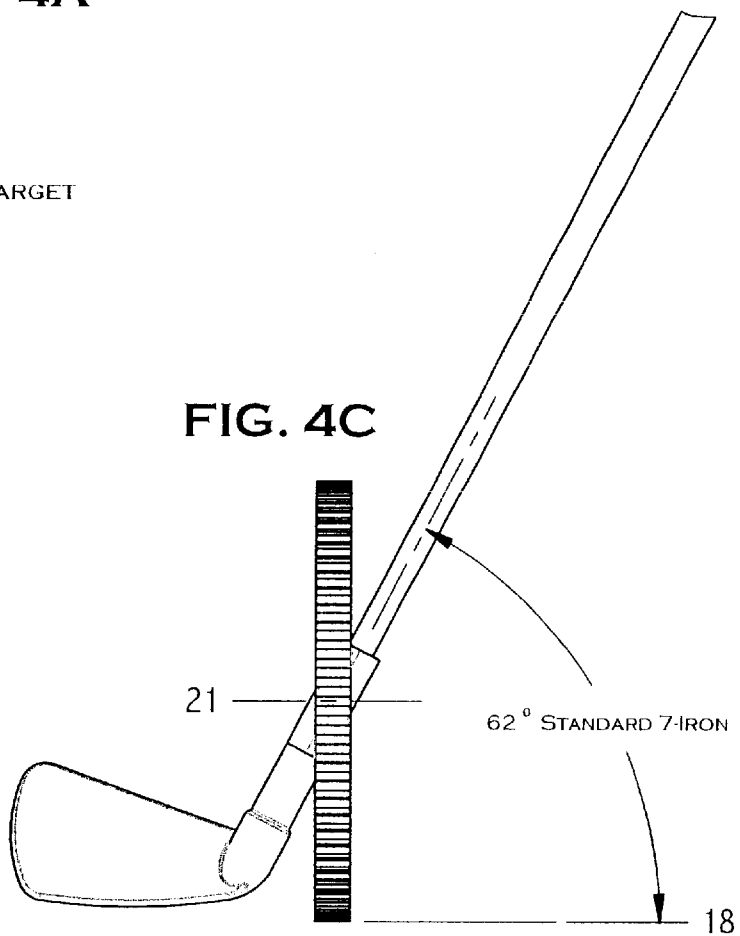
Figure 5D:
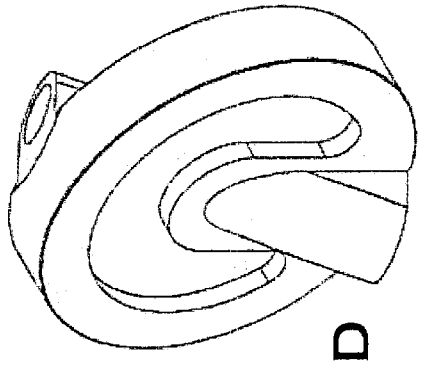
FIG. 5 shows three orthographic views, including a sectional view and an isometric view, of the inner hub component (item 11 in FIG. 2).
Figure 5C:
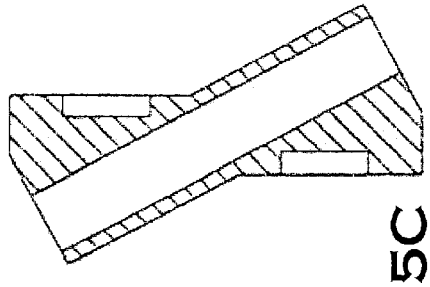
Figure 5A:
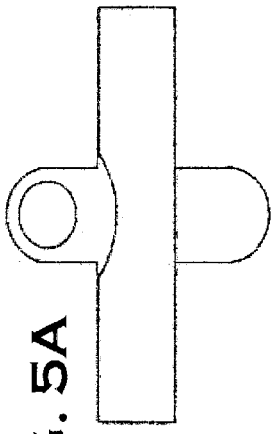
Figure 5B:
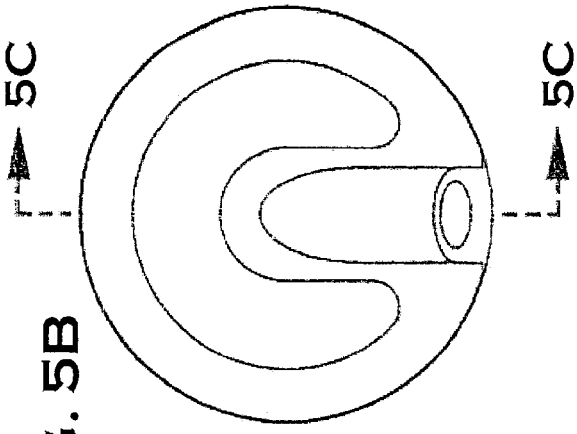
Figure 6:
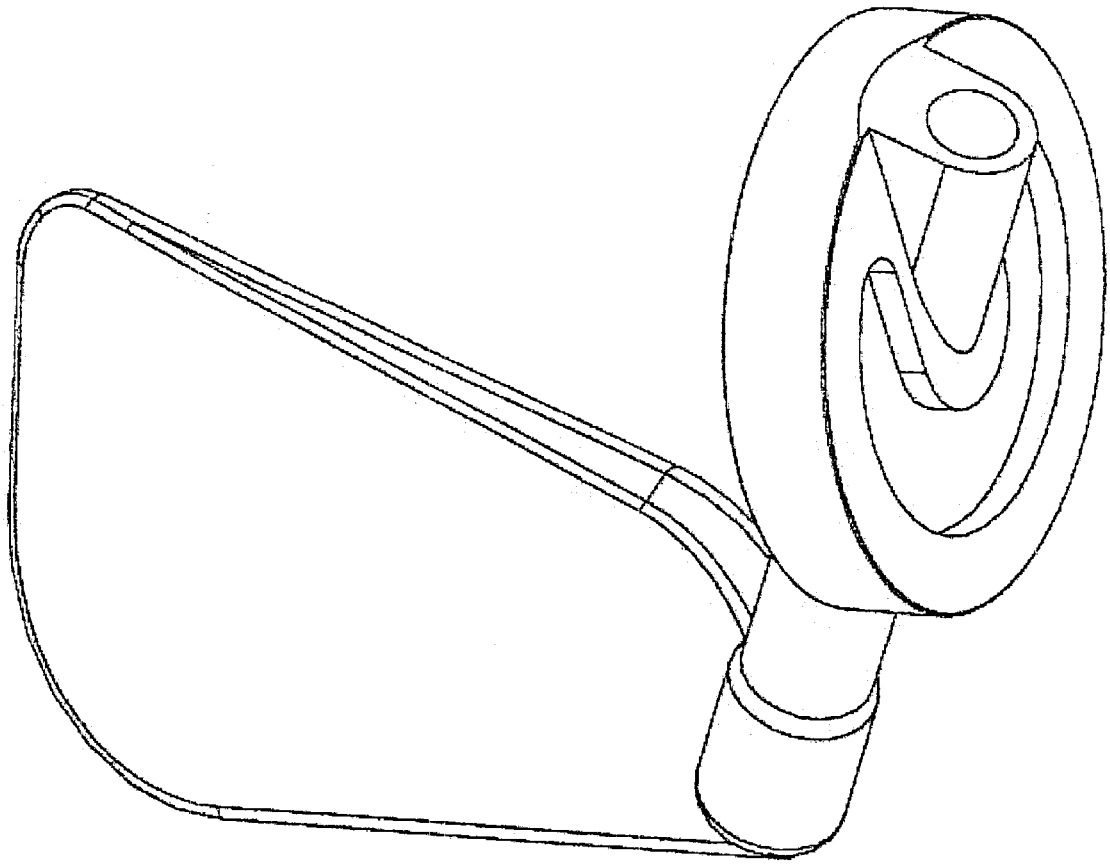
FIG. 6 is an isometric representation of a related embodiment where the inner hub is constructed integrally with the clubhead (item 13 in FIG. 2), via a casting process or CNC machining methods. The result is a one-piece component having built-in, precision alignment of the hub features to the design parameters of the clubhead itself.
Figure 7:
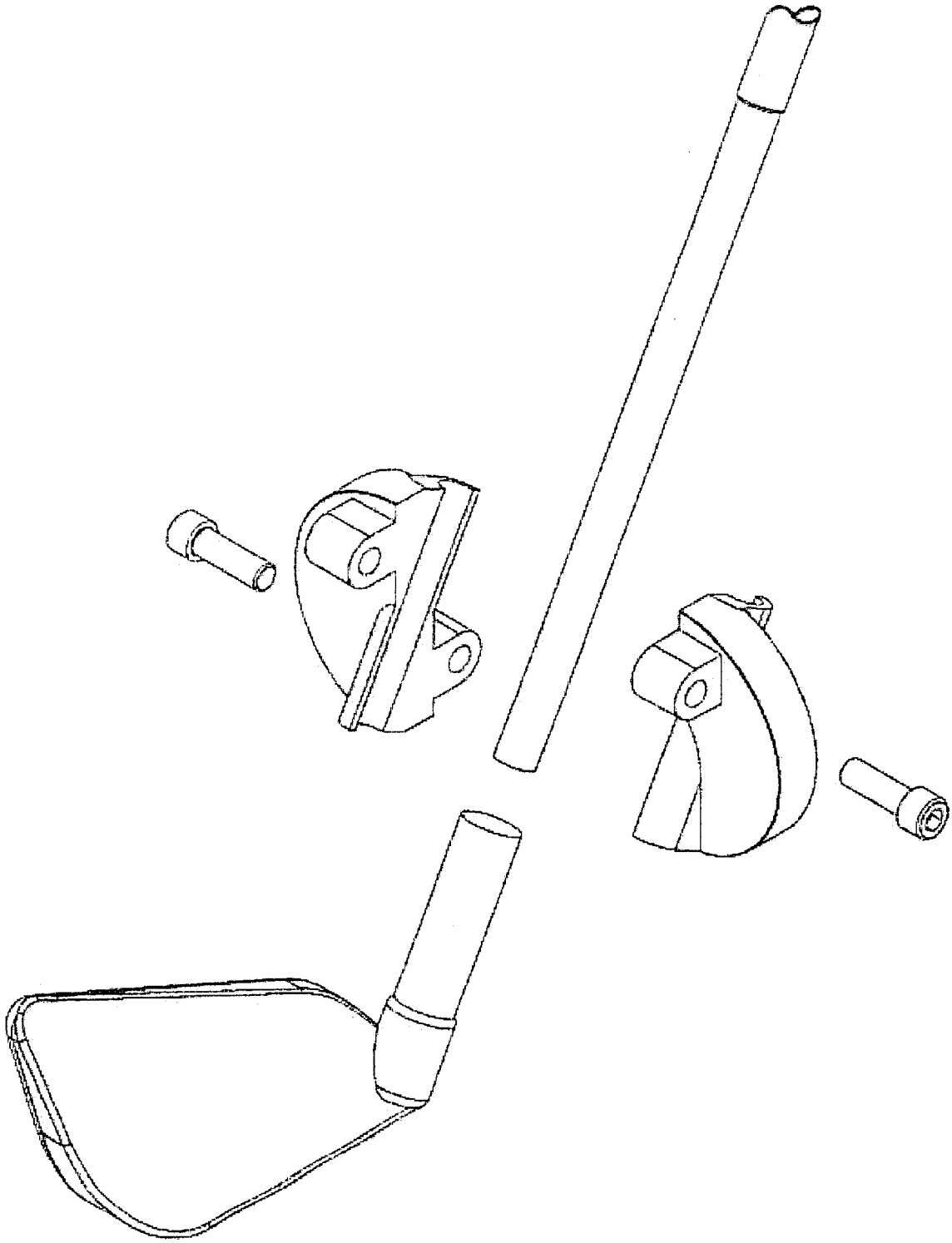
FIG. 7 is an isometric view of a related embodiment where the inner hub is comprised of a two-piece construction so that it may be secured releasably, using threaded fasteners, clamps, or other means, to an existing, previously assembled golf club—in order to avoid the need for extracting the shaft from the hosel in order to install the wheel assembly.
Figure 8A:
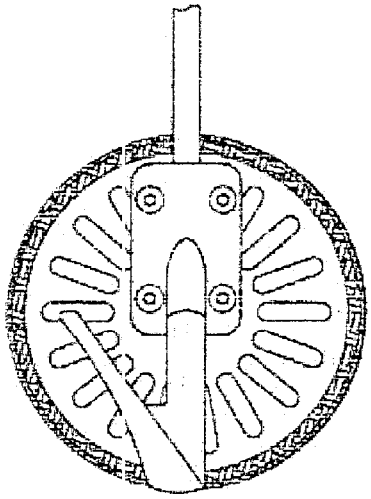
FIG. 8 shows front and side views of two similar embodiments where the wheel assembly is mounted below the shaft of the golf club, allowing the use of a smaller wheel diameter and radial bearing. The detachable versions are shown, although similar embodiments could be designed to be integral with or permanently affixed to the clubhead itself.
Figure 8B:
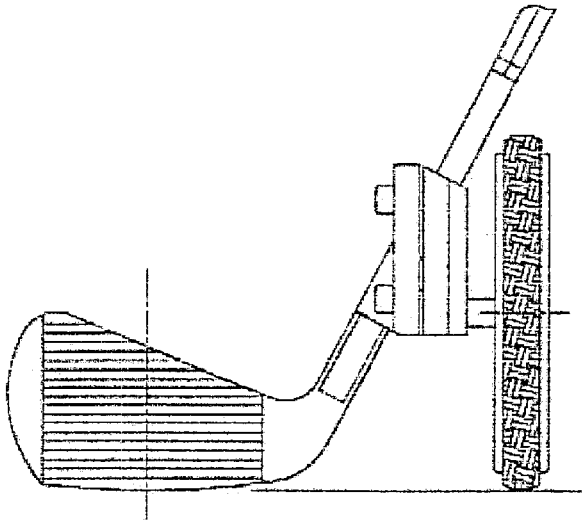
Figure 8C:
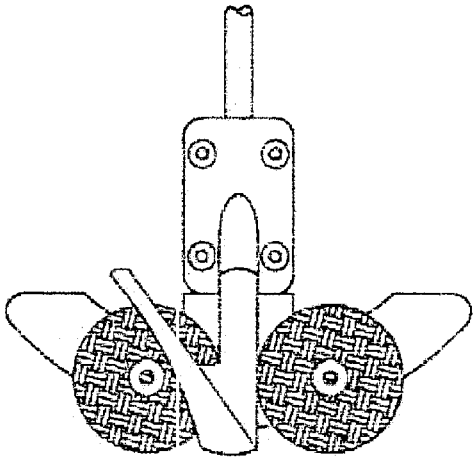
Figure 8D:
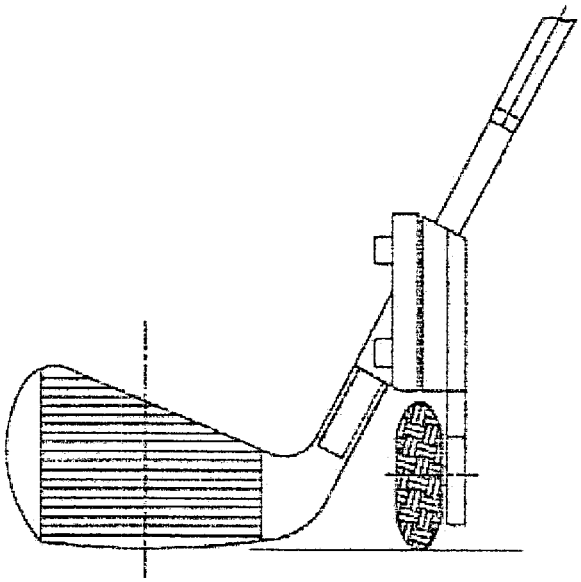
Figure 9A:
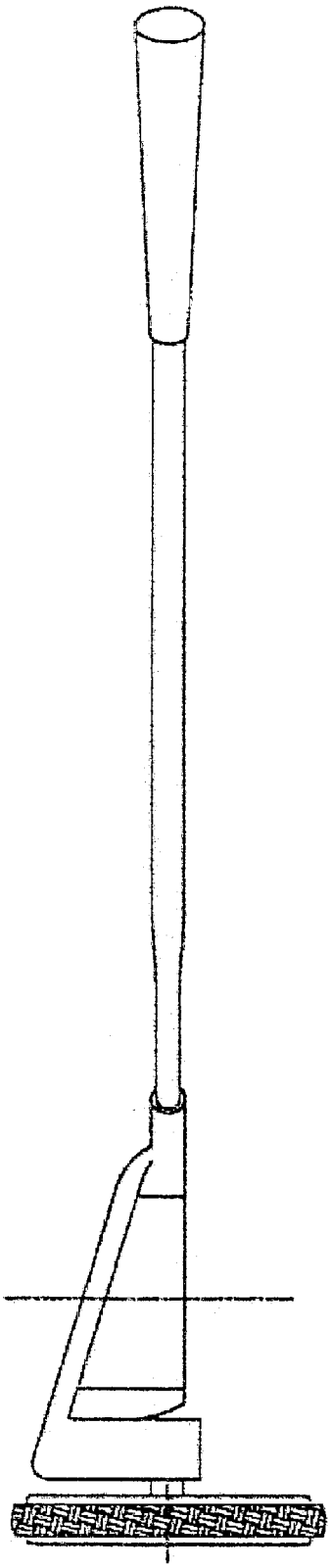
Figure 9B:
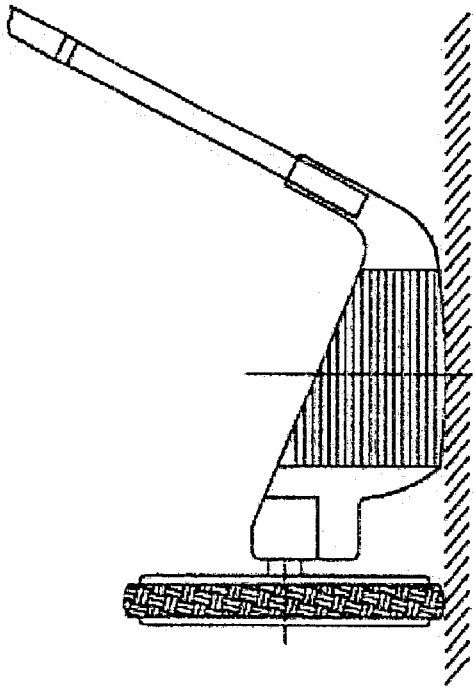

FIG. 9 contains top and side views of a related embodiment where the wheel assembly is mounted external to the toe portion of the clubhead. The hub component is shown as a one-piece construction with the clubhead itself, although it could be made detachable in a similar embodiment.

Figure 10B:
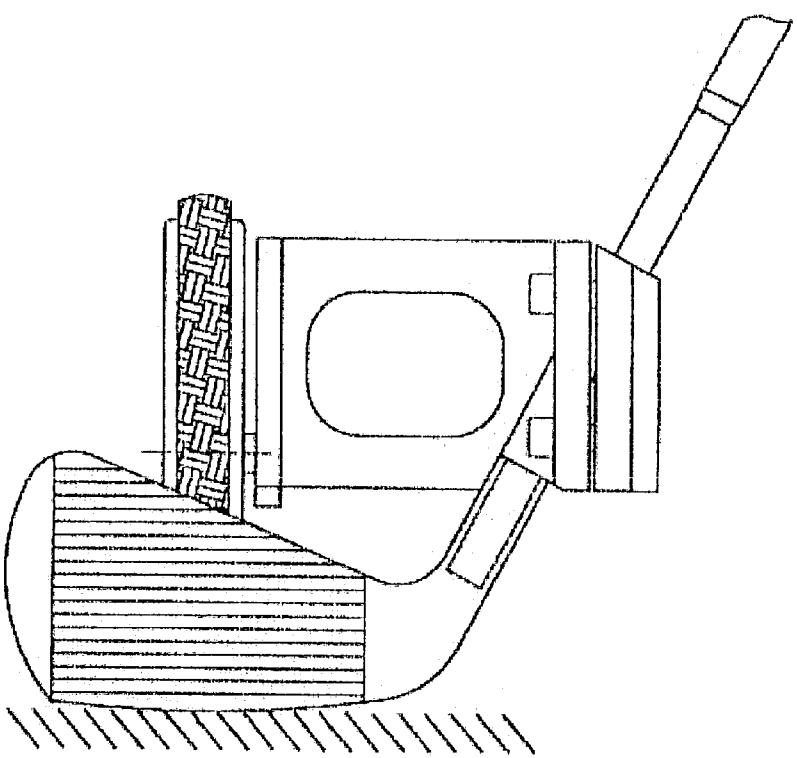
Figure 10A:
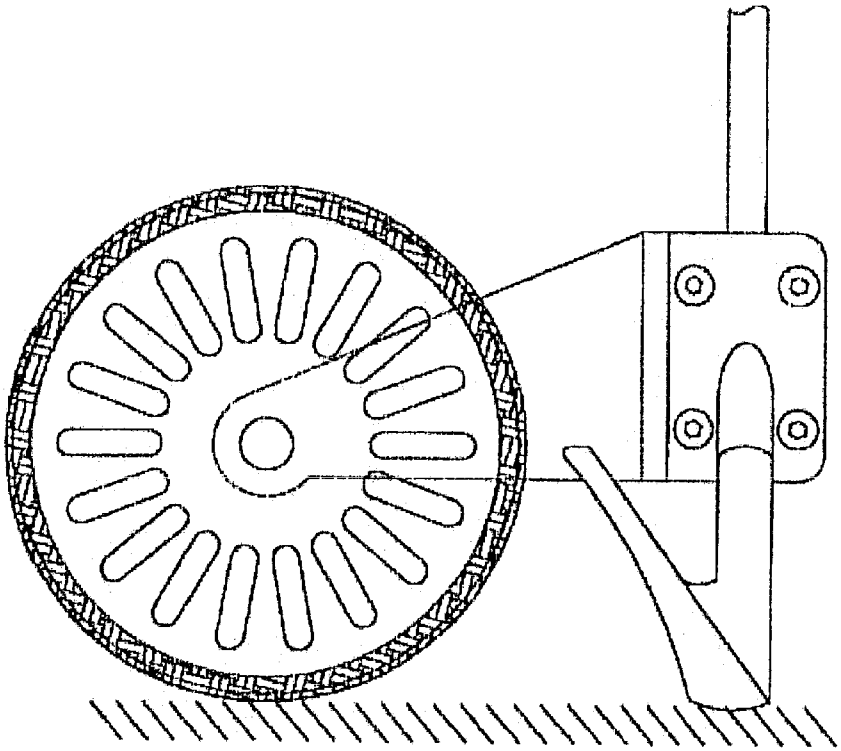

FIG. 10 shows top and front views of a related embodiment where the wheel assembly is mounted behind, and in-line with, the clubface. The hub component is shown as a bracket assembly, clamped detachably to the shaft, although conceivably it could be made integral with the clubhead itself.

Figure 11:
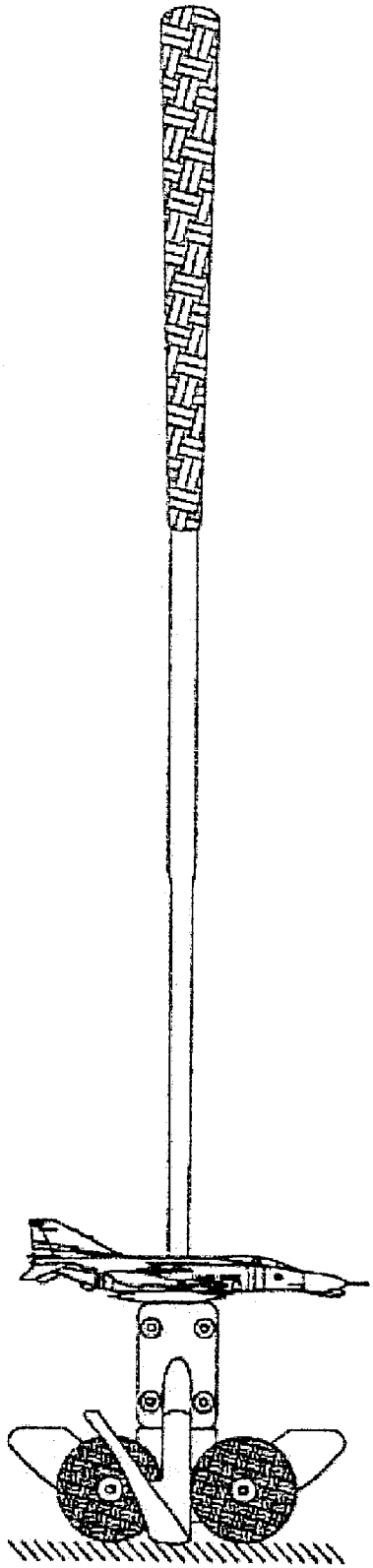

FIG. 11 shows a construction as illustrated in FIG. 8 having an optional enhancement whereupon the wheel assembly acts as a metaphor for the landing gear of an attached toy airplane. This device would be suitable primarily for children, and other toys such as cars, trucks, trains, or motorcycles could be mounted in place of the airplane shown.

Figure 12A:
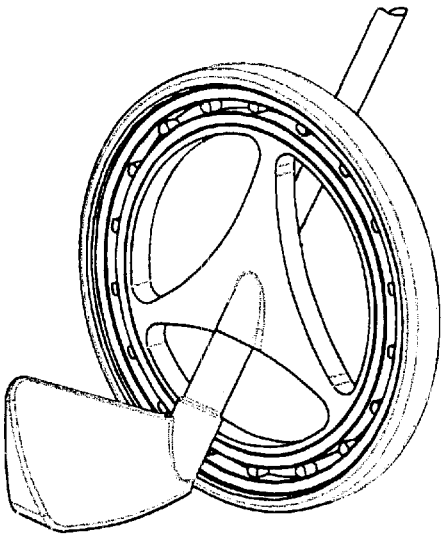
Figure 12B:
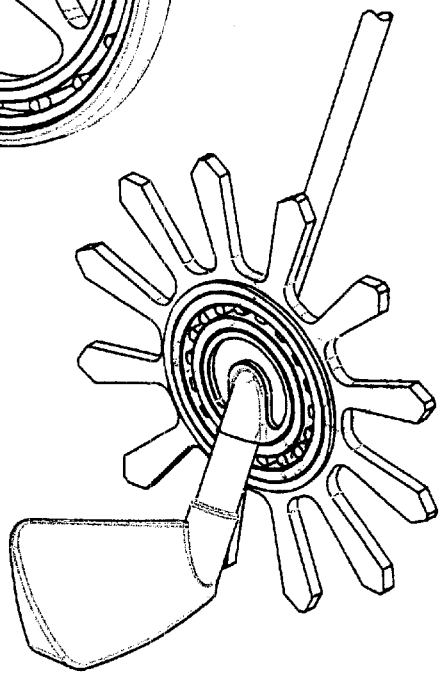
Figure 12C:
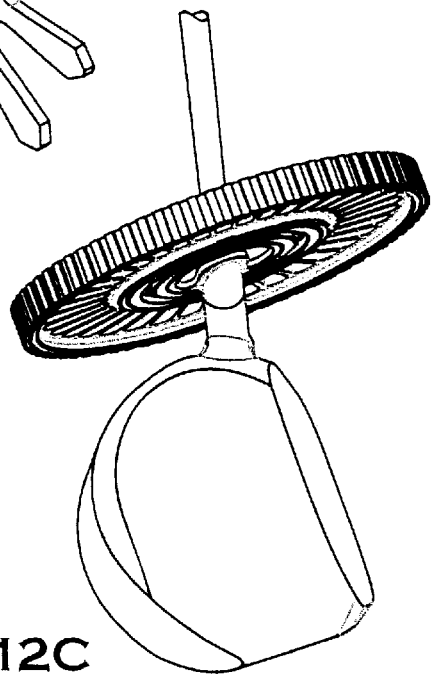

FIG. 12 shows isometric views of three related versions of the preferred embodiment of the wheel assembly. The intent here is to show that cosmetic design changes to the basic components do not alter the spirit or function of the training-wheel device, and that a multitude of "looks and feels" are possible without departing from the scope of the invention claimed here.

| Reference Numerals in Drawings | |
|---|---|
| 11 inner hub | 18 plane of the ground |
| 12 club shaft | 19 line defining the leading edge of the clubface |
| 13 clubhead | 20 target line |
| 14 radial bearing | 21 axis of rotation of wheel |
| 15 outer hub | |
| 16 tread ring | |

OPERATION

In operation one uses the golf club with attached training-wheel assembly in the same, orthodox manner as one uses an ordinary golf club. The addition of the wheel assembly is intended as a training aid—an enhancement to normal practice—which can conceptually integrate the "piecemeal" complexities of the golf swing motion and reduce them to a cohesive and intuitive action. The presence, location and orientation of the wheel will provide:

(1) Kinesthetic, auditory, and visual feedback via the rolling action of the wheel against the ground in both the backswing and forward swing.

(2) Kinesthetic, auditory, and visual feedback via the free-spinning action of the wheel as it leaves the surface of the ground.

(3) A highly visible reference for the target line and swing plane geometry.

(4) A highly visible vertical reference to the plane of the ground.

(5) A highly visible reference for the precise aim of the clubface and lie angle of the golf club.

(6) A resilient surface for absorbing the shock of impact with the ground and preventing wear, and a means of promoting a shallow, sweeping or collecting action through impact rather than an overly-steep, vertical attack on the ball.

(7) An additional mass suitable for golf swing training oriented towards muscular development and cardiovascular exercise.

As explained earlier, the wheel assembly can be permanently attached or made to be detachable, and can also have toy vehicles or other adornments or ornamentation suitable for encouraging the optimal, conceptual use of the device.

What is claimed is:

1. A golf swing training device, comprising:

a golf club composed of a shaft, handle, and clubhead; oriented, with respect to a relatively flat and level playing surface, in an address position commensurate with the designed loft and lie angles intended by the clubhead manufacturer, the clubface aimed in a square alignment with respect to a target line on said playing surface, having a free-spinning wheel or roller assembly, having a suitably stiff and lightweight construction or a rim-and-spokes type construction, including a radial bearing, either permanently mounted to, or integral with, or having means for releasably securing and aligning said wheel or roller assembly to the golf club shaft or hosel so that it may be attached and detached from a previously constructed golf club without the necessity of extracting the shaft from the hosel, with the diameter of the wheel or roller and the vertical location and alignment of the said mounting with respect to the golf club being so predetermined that the axis of rotation of the wheel or roller assembly is perpendicular to the target line and parallel to the playing surface, and that when the clubface of the golf club is at said address position, the perimeter of the wheel or roller will be in substantial, tangential contact with the playing surface.

2. A golf swing training device as defined in claim 1 wherein the wheel or roller assembly is located directly below the shaft of said golf club.

3. A golf swing training device as defined in claim 1 wherein the wheel or roller assembly, is located outboard or external to the toe portion of the golf clubhead, such that the clubhead is between said wheel assembly and the user.

4. A golf swing training device as defined in claim 1 wherein the wheel or roller assembly is located directly behind the clubface, parallel to the target line, and in a direction opposite the intended target.

* * * * *